United States Patent [19]

Klaren

[11] 3,991,816

[45] Nov. 16, 1976

[54] METHOD OF EXCHANGING HEAT AND HEAT EXCHANGER

[75] Inventor: Dick Gerrit Klaren, Hillegom, Netherlands

[73] Assignee: Gustav Adolf Pieper, Heemstede, Netherlands

[22] Filed: Nov. 25, 1974

[21] Appl. No.: 527,036

[30] Foreign Application Priority Data

Nov. 30, 1973 Netherlands ..... 7316401

[52] U.S. Cl. ..... 165/1; 23/288 S; 122/4 D; 165/104 F

[51] Int. Cl.[2] ..... F28D 13/00

[58] Field of Search ..... 165/104 F, 1; 23/288 S; 122/4 D

[56] References Cited

UNITED STATES PATENTS 2,919,118 12/1959 Hunter ..... 165/104 F

*Primary Examiner*—Albert W. Davis, Jr.
*Attorney, Agent, or Firm*—Stevens, Davis, Miller & Mosher

[57] ABSTRACT

A method and apparatus for exchanging heat between a moving fluid and a moving secondary fluid comprising passing a plurality of streams of secondary fluid upward through the moving primary fluid.

16 Claims, 2 Drawing Figures

METHOD OF EXCHANGING HEAT AND HEAT EXCHANGER

Figure 1:
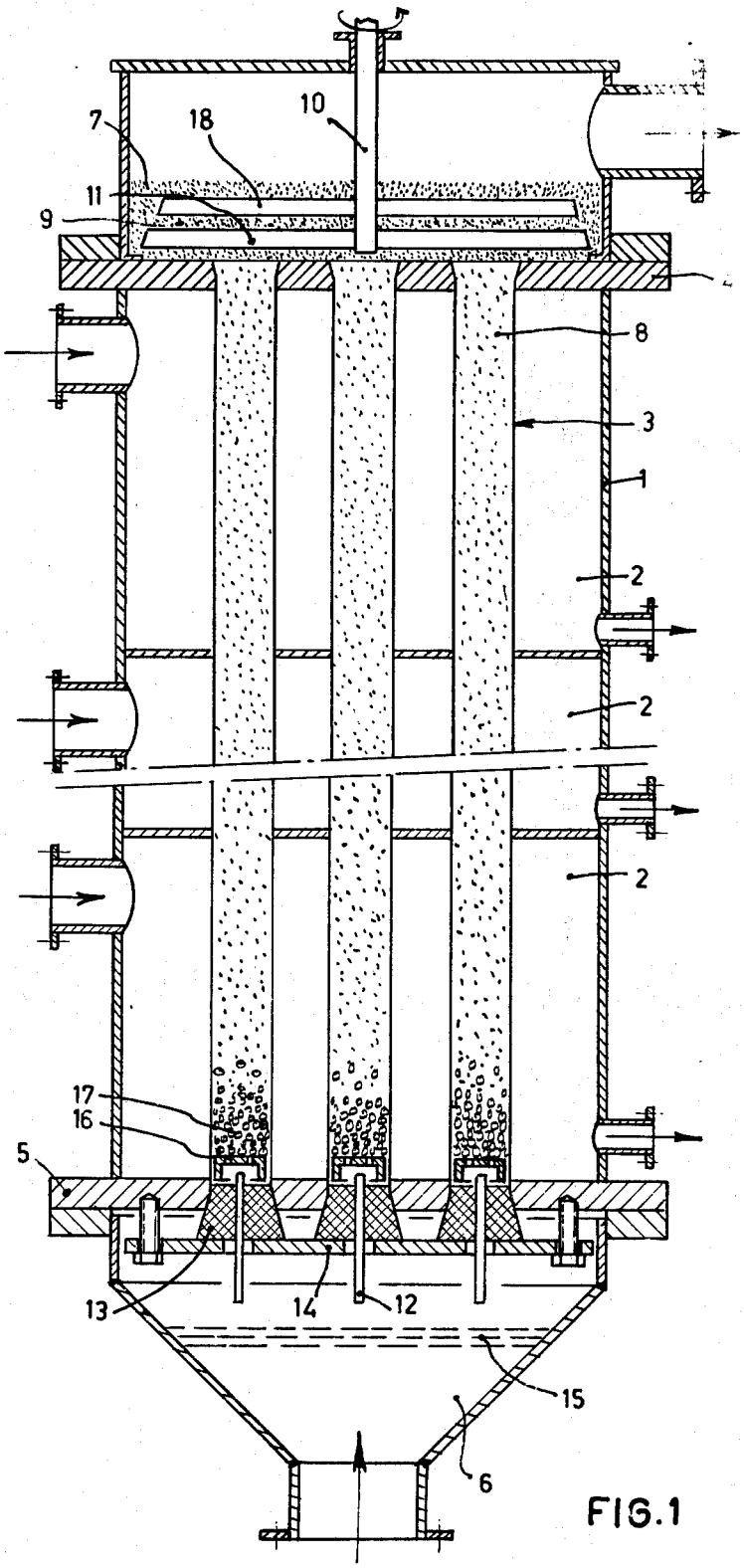

This invention relates to methods of heat exchange and to heat exchangers.

Heat exchangers having one or more vertically arranged compartments for a primary fluid through which pass a plurality of parallel exchanger tubes for upward flow of a secondary fluid are known. Usually in such heat exchangers the exchanger tubes extend from an inlet box to an outlet box, the top of the inlet box and the bottom of the outlet box consisting of tube plates having apertures in which the tube plates are mounted.

It is desirable to keep the volume of such heat exchangers as small as possible, particularly to keep the length of the exchanger tubes, and thus the height of the exchanger, to a minimum. To achieve this, high efficiency of heat exchange is required; particularly important is the rate of heat transfer between the walls of the exchanger tubes and the secondary fluid in them. The rate of flow of the secondary fluid is preferably low.

It is known to provide solid particles in the exchanger tubes which particles form fluidised beds in the fluid flowing in the tubes. This measure improves heat transfer between the fluid and the tube wall, but has not hitherto been satisfactory because of the difficulties of ensuring uniformity of height and density of the fluidised beds in the different tubes. It is desirable that the fluidised beds extend over the full height of the tubes where they are contacted by the primary fluid.

According to the invention there is provided a method of heat exchange in a heat exchanger between a primary fluid and a secondary fluid, wherein the secondary fluid is in one or more compartments through which the secondary fluid passes upwardly in a plurality of exchanger tubes and solid particles in each tube are maintained as a fluidised bed by the upward flow of the secondary fluid, the tubes opening at their upper ends into a layer of the solid particles in a chamber which layer is stirred during heat exchange.

In this manner, it can be ensured that the fluidised bed in each tube extends over the full height of the tube where it is contacted by the secondary fluid. If there is at anytime an insufficient number of particles in any one tube, further particles can enter that tube from the stirred layer of particles. The stirring of the layer should prevent bridge or dome formation above the ends of the tubes. Advantageously the stirring moves the particles in the layer horizontally.

Thus the length of the tubes can be kept to a minimum and a compact but efficient design of heat exchanger can be achieved.

According to the invention in another aspect, there is provided a heat exchanger for exchange of heat between a primary fluid and a secondary fluid, having at least one compartment for the primary fluid through which pass a plurality of exchanger tubes arranged for upward flow of the secondary fluid, the tubes debouching at their upper ends into an outlet box and solid particles being provided which in operation of the heat exchanger provide a fluidised bed in each of the tubes, wherein said particles in operation of the heat exchanger also provide a layer in the outlet box, into which layer the upper ends of the tubes open, there being provided means for stirring said layer.

It is known to provide throttling means at the inlets to heat exchanger tubes to control the flow rate of the secondary fluid in the tubes. Preferably, in the method of the invention or in the heat exchanger of the invention, the flow of secondary fluid in each tube is throttled below the fluidised bed, the degree of throttling being selected for each tube so as to reduce the variations among the tubes of the degree of compaction of the particles in the respective fluidised beds during operation. Looked at from another point of view, the throttling effect should be selected for each tube so as to reduce the variation of the heights of the fluidised beds among the different tubes (since the fluidised beds extend in practice into a layer of particles above the tube ends, these heights are the theoretical heights of the beds).

It has been found to be advantageous if the flow of secondary fluid in each tube is throttled below the fluidised bed to such a degree that the following relation is satisfied for each tube respectively:

$$\Delta p > (0{,}20\ E - 0{,}13)\ (G/F - 0{,}65\ \rho Lg/E)$$

wherein $\Delta p$ is the pressure difference in the secondary fluid resulting from the throttling action;

$E$ is the relation between the length of the tube between the upper and lower points contacted by the primary fluid and the length for which the tube is filled under non-fluidising conditions by the said particles which in operation are fluidised;

$G$ is the weight of all solid particles in the tube;

$F$ is the cross-sectional area of the tube;

$\rho$ is the average density of the secondary fluid in the tube;

$L$ is the length of the tube between the upper and lower points which are contacted by the primary fluid; and $g$ is the acceleration of gravity.

Conditions in which the above relation is fulfilled can be established empirically in any given case.

Figure 2:
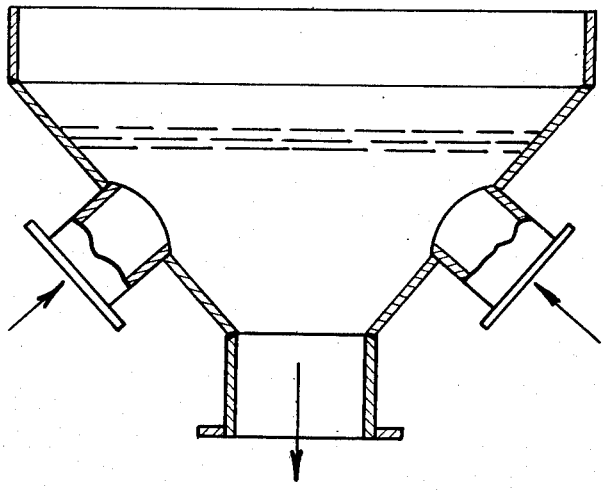

Further advantageous features which may form a part of the invention are discussed in the following description of one embodiment of the invention, given by way of example, and with reference to the accompanying drawings, in which:

FIG. 1 is a diagrammatic vertical cross-section through a heat exchanger embodying the invention; and FIG. 2 is a schematic view of an alternative form of inlet box for the heat exchanger of FIG. 1.

As shown in FIG. 1, the heat exchanger column consists of a mantle 1, which in this case is sub-divided into a plurality of compartments 2 through all of which pass parallel vertical exchanger tubes 3. The tubes 3 at their ends are fixed in tube plates 4 and 5.

In the compartments 2 a primary fluid circulates outside the tubes 3. The primary fluid may be different from one compartment to another, whereas the secondary fluid, which from the inlet box 6 flows upwardly through the tubes to the outlet box 7, is the same for all compartments.

The tubes 3 are partially filled with solid particles 8 which cannot fall downwardly out of the tubes 3 because of a throttling device, to be described later, in the inlet of each tube. Under normal operating conditions the solid particles are fluidised as a bed extending into the outlet box and thus extending over the entire length of the tubes 3, because of the upward velocity of the secondary fluid. During normal operation solid particles are present in a layer 9 above the outlet openings of the tubes 3 and on the tube plate 4.

The illustrated heat exchanger is particularly suitable for efficient heat exchange at low flow rates in the exchanger tubes 3. The throttling of flow which is required, and which usually leads to a substantial pressure drop, can be achieved by known throttling devices, such as a single throttling plate, or a plurality of throttling plates, or a plurality of throttling plates in series. These however have a tendency to become clogged with particles carried by secondary fluid. Clogging can only be prevented by a high degree of filtration of the secondary fluid which is costly and adds complication. Throttling devices consisting of a series of throttling plates can have the further disadvantage that they tend to have mutually varying resistance to flow, which can hinder the achievement of uniform fluidisation.

These disadvantages can be reduced or eliminated if, as is preferred in the practice of the invention, the throttling means in each exchanger tube is a throttling tube through which the secondary fluid passes, the bore of the throttling tubes being smaller than that of the exchanger tube.

As shown in FIG. 1, the throttling device in each tube 3 comprises a supply tube 12 with an internal diameter which is relatively narrow as compared with the internal diameter of the tube 3, the tube 12 being mounted in a plug 13 which in turn is pressed into the inlet opening of the tube 3 by a pressure plate 14. The degree of throttling of the secondary fluid at the inlet of the tube 3 is now mainly determined by the length and the internal diameter of the tube 12 and by the velocity of the secondary fluid in the tube 12. The latter factor itself in turn depends upon the velocity of the secondary fluid in the tube 3 and the relation between the cross-sections of the tube 12 and the tube 3.

In such a throttling device the possibility of obstruction of the tube 12 can be reduced as desired by increasing its cross-section, while the required throttling action can yet be obtained by increasing the length of the tube 12 sufficiently. Depending upon the required length of the tube 12 and the volume which is available for the throttling device, the supply tube may be straight, or may be round in a spiral form or in the form of a helix.

The winding of a longer tube 12 into the form of a spiral or a helix is desirable because in certain cases an increased tube length is to be accommodated in as small a volume as possible.

For instance for a heat exchanger with parallel tubes of which the total length between the tube plates in the inlet box and in the outlet box respectively is 10 m, and with a value of 2 for the factor of the relation given above, in which the particles 8 are glass balls of diameter 2mm, the minimum required pressure drop across the throttling device should amount to about 2.5 m WK. if the tubes 3 have an internal diameter of 13.44 mm (⅝ inch tube with a wall thickness of 1.22 mm) and the flowspeed amounts to about 10 cm/sec., while the tube 12 has an internal diameter of 3 mm, by calculation from the pressure drop the required length of the supply tube 12 is about 1.20 m. By winding this length in the form of a spiral or helix a considerable saving of the volume occupied by the throttling device is obtained.

In order to further reduce the possibility of clogging of the tubes 12 one or more sieve plates 15 are provided in the inlet box, the plates 15 having perforations which are smaller in area than the cross-section of the bore of the tubes 12.

Other advantageous features of the heat exchanger of FIG. 1 are:

- the impact plate 16 which disrupts the stream or jet of secondary fluid from the tube 12 by reducing its velocity and dividing the flow of secondary fluid uniformly across the cross-section of the tube 3, and
- the layer of solid particles 17 which are coarse in comparison with the particles 8 and which as a result of proper selection of their size and their specific weights cannot be fluidised by the secondary fluid. They also prevent obstruction of the openings in the impact plate 16 and/or the tube 12 and by their presence reduce the possibility of clogging by finer solid particles which can be fluidised.

A great advantage of the heat exchanger of FIG. 1 is the presence of the layer 9 of particles 8 into which the tubes 3 open in the outlet box 7. This layer 9 permits variation of the flow rate of secondary fluid because adjustment of the quantity of particles 8 in the fluidised bed in each tube 3 to the correct amount for the chosen flow rate takes place automatically, within limits. Thus an increase in the flow rate of the secondary fluid reduces the quantity of particles in each tube 3 and increases the thickness of the layer 9, which upon reduction of the flow rate of secondary fluid, the fluidised beds in the tubes 3 are supplemented by particles which enter from the layer 9.

To ensure smooth transference of particles as required between the tubes 3 and the layer 9, it is desirable to stir the layer 9 in any suitable manner, i.e. to give it continuous or intermittent motion. In the heat exchanger of FIG. 1, there is a stirrer mounted on a vertical shaft 10 which is driven by either mechanical or hydraulic means. The stirrer consists of one or more blades 11 attached to the free end of the shaft 10. The blades 10 are present in the layer 9 of solid particles next to the outlet openings of the tubes 3, and make a horizontal rotary movement. Alternatively a wiping movement could be employed. If the layer of solid particles has a very large surface area, it may be necessary to employ a plurality of parallel stirring devices of the above described type, which together stir the entire layer.

The design in which a plurality of stirrers is employed can also be used when it is desired to reduce the flow of secondary fluid to a level which is insufficient to keep a layer of solid particles in the outlet box. If such a serious reduction of the mass flow is desired in operating the exchanger, then it is preferable to split up the inlet and outlet boxes into corresponding segments, so that one or more segments can be completely shut down; the tubes 3 of the remaining segments continue their normal operation in which the fluidised beds in the tubes 3 extend into the outlet box. A consequence of such a design may be that a rotating stirring device in the outlet box cannot be used, but must be changed to wipers. Wipers can, in the same way as in the above described stirring device, be attached to a vertical shaft, provided with either one or more wiping blades.

Apart from breaking up dome formation in the solid particles in the layer 9 next to the exit openings of the tubes 3, the stirring of the layer 9 also prevents the clogging of this layer with dirt by the secondary fluid. To this end it is desirable that, apart from the blades 11 which are provided closely above the exit openings of the tubes 3 in order to prevent dome or bridge-formation, one or more blades 18 are provided which are attached to the shaft 10 in one or more planes above the blades 11 and stir that part of the layer of solid particles which cannot be reached by the blades 11.

The inlet box 6 may be provided with a diverging inlet in order to provide a uniform flow of the tube plate 5. If the secondary fluid contains much dirt, it is advisable to shape the inlet box as shown in FIG. 2. Here, the inlet box has, over part of its height, the shape of an inverted frusto-cone, there being an outlet at the narrow bottom end. The secondary fluid is admitted via one or more inlets into the inlet box. Because of the extremely low velocities in the inlet box dirt may deposit in the conical part of the inlet box, from which it may be removed periodically. A further possibility is to select the largest cross-sectional area of the inlet box at a value greater than the largest cross-sectional area of the outlet box. In this way it can be achieved that dirt which did not deposit in the inlet box, also cannot deposit in the outlet box. Thus practically all gathering of dirt in the installation may be prevented, which of course benefits the reliability of operation of the installation.

The tubes 3 which provide the heat exchanging surface of the column, may be normal polished cylindrical tubes. However, they may alternatively have a grooved design. For tubes having a grooved inner surface, it is preferable that the radius of curvature in the bottom of the groove at the inner side of the tube should be greater than or equal to the average radius of the paticles to be fluidised.

What I claim is:

1. Heat exchanger for exchange of heat between a primary fluid and a secondary fluid, having at least one compartment for the primary fluid through which pass a plurality of exchanger tubes arranged for upward flow of the secondary fluid, the tubes debouching at their upper ends into an outlet box and solid particles being provided which in operation of the heat exchanger provide a fluidised bed in each of the tubes, wherein said particles in operation of the heat exchanger also provide a layer in the outlet box, into which layer the upper ends of the tubes open, there being provided means for stirring said layer.

2. Heat exchanger according to claim 1 wherein each tube is provided with means for throttling the flow of secondary fluid below the fluidised bed.

3. Heat exchanger according to claim 2 wherein the throttling means in each exchanger tube is a throttling tube through which the secondary fluid passes, the bore of the throttling tube being smaller than that of the exchanger tube.

4. Heat exchanger according to claim 3 including a sieve plate provided in the flow path of the secondary fluid upstream of the said throttling tube, the sieve plate having apertures of smaller area than the bore of the throttling tube.

5. Heat exchanger according to claim 3 including an impact plate on each tube to disrupt the stream of fluid emitted from the throttling means.

6. Heat exchanger according to claim 1 wherein said means for stirring comprises at least one rotary stirrer rotatable about a vertical axis and arranged in the outlet box.

7. Heat exchanger according to claim 6 wherein said stirrer has in at least one plane a plurality of stirring blades attached to a vertical shaft.

8. Heat exchanger according to claim 9 wherein said wiper has in at least one plane a plurality of wiping blades attached to a vertical shaft.

9. Heat exchanger according to claim 1 wherein said means for stirring is positioned in the outlet box and is a wiper movable with a reciprocating motion.

10. Heat exchanger according to claim 1 wherein the tubes extend upwardly from an inlet box which is at least partly in the form of an inverted frusto-cone having an outlet at its narrow end for release of solid material collecting in said narrow end, the largest cross-sectional area of the inlet box being greater than the largest cross-sectional area of the outlet box.

11. Heat exchanger according to claim 1 wherein the exchanger tubes are grooved internally.

12. A method for exchanging heat between a moving primary fluid and a moving secondary fluid comprising passing a plurality of streams of secondary fluid upward through the moving primary fluid, each of said streams of secondary fluid containing solid particles, setting the speed of flow of said secondary fluid to maintain said particles as a fluidized bed, establishing a layer of solid particles at the upper termini of said streams of secondary fluid and stirring the solid particles in said layer during heat exchange.

13. The method of claim 12 including selectively throttling the secondary fluid in each stream below the fluidized bed, so as to reduce the variations among the streams of the degree of compaction of the particles in the respective fluidized beds during operation.

14. Method according to claim 13, wherein the flow of secondary fluid in each stream is throttled below the fluidized bed to such a degree that the following relation is satisfied for each stream respectively:

$$\Delta p > (0{,}20\ E - 0{,}13)\ (G/F - 0{,}65\ \rho Lg/E)$$

wherein $\Delta p$ is the pressure difference in the secondary fluid resulting from the throttling action;

$E$ is the relation between the length of the stream between the upper and lower points contacted by the primary fluid and the length for which the stream is filled under non-fluidizing conditions by said particles which in operation are fluidized;

$G$ is the weight of all solid particles in the stream;

$F$ is the cross-sectional area of the stream;

$\rho$ is the average density of the secondary fluid in the stream;

$L$ is the length of the stream between the upper and lower points which are contacted by the primary fluid; and $g$ is the acceleration of gravity.

15. Method according to claim 12 including continuously stirring said layer of solid particles.

16. Method according to claim 12 including intermittently stirring said layer of solid particles.

* * * * *

UNITED STATES PATENT AND TRADEMARK OFFICE

CERTIFICATE OF CORRECTION

PATENT NO. : 3,991,816

DATED : November 16, 1976

INVENTOR(S) : Dick Gerrit KLAREN

It is certified that error appears in the above-identified patent and that said Letters Patent are hereby corrected as shown below:

Column 1, line 14, cancel "plates"(second occurrence) and insert -- ends --.

Column 3, line 56, after "factor" insert -- E, as defined above, --.

Signed and Sealed this

Eighth Day of March 1977

[SEAL]

*Attest:*

RUTH C. MASON
*Attesting Officer*

C. MARSHALL DANN
*Commissioner of Patents and Trademarks*